US005165677A

United States Patent [19]

Shinada

[11] Patent Number: 5,165,677

[45] Date of Patent: Nov. 24, 1992

[54] INTERMEDIATE PAPER FEEDING DEVICE FOR A COPIER OPERABLE IN A TWO-SIDE COPY MODE

[75] Inventor: Masayuki Shinada, Yokohama, Japan

[73] Assignee: Ricoh Company, Ltd., Tokyo, Japan

[21] Appl. No.: 639,888

[22] Filed: Jan. 11, 1991

[30] Foreign Application Priority Data

| | | | |
|---|---|---|---|
| Jan. 12, 1990 | [JP] | Japan | 2-2169[U] |
| Jan. 14, 1990 | [JP] | Japan | 2-2311[U] |
| Jan. 14, 1990 | [JP] | Japan | 2-2312[U] |
| Nov. 7, 1990 | [JP] | Japan | 2-299754 |

[51] Int. Cl.[5] ..... B65H 3/06

[52] U.S. Cl. ..... 271/3.1; 271/245

[58] Field of Search ..... 271/3.1, 241, 245

[56] References Cited

U.S. PATENT DOCUMENTS 4,928,151 5/1990 Saeki ..... 271/3.1 X 4,957,285 9/1990 Yamada ..... 271/245 X

*Primary Examiner*—Richard A. Schacher

*Attorney, Agent, or Firm*—Oblon, Spivak, McClelland, Maier & Neustadt

[57] ABSTRACT

An intermediate paper feeding device for a copier operable in a two-side copy mode. A stop for positioning paper sheets stacked on an intermediate tray guides, in the event of refeed, a paper sheet toward the contacting portion of a separating member pair. A presser member for pressing the top of a paper stack loaded on the intermediate tray is operated in interlocked relation to the stop. The stop and presser member, therefore, share a single drive mechanism. The presser member has a pressing surface which remains in surface-to-surface contact with the top of the paper stack on the tray over substantially the entire area thereof with no regard to the thickness of the paper stack.

3 Claims, 4 Drawing Sheets

1ST GATE SOL.

2ND GATE SOL.

PRESS SOL.

INLET SENSOR

POSITION ROLLER SOL.

JOGGER FENCE MOTOR

PAPER END SENSOR

INTERMEDIATE PAPER FEEDING DEVICE FOR A COPIER OPERABLE IN A TWO-SIDE COPY MODE

BACKGROUND OF THE INVENTION

The present invention relates to a copier operable in a two-side copy mode and, more particularly, to an intermediate paper feeding device for such a copier.

A copier operable in a two-side copy mode is extensively used today and has an intermediate paper feeding device for implementing the two-side copy mode. The intermediate paper feeding device has an intermediate tray to be loaded with a stack of paper sheets each carrying an image on one side thereof, i.e. one-sided paper sheets. To print images on the other side of the one-sided paper sheets, the paper feeding device refeeds the paper sheets one by one from the intermediate tray, the lowermost one being first. This type of intermediate paper feeding device, or so-called bottom feed type device, has customarily been implemented with either one of a pneumatic paper separation scheme and a frictional paper separation scheme. The pneumatic separation scheme uses a suction belt which contacts the underside of a paper stack loaded on the intermediate tray. The suction belt is driven while sucking the lowermost paper sheet and thereby entrains the lowermost paper sheet away from the overlying paper sheets toward a separating and transporting member pair. On the other hand, the frictional separation scheme uses a presser member which presses the top of the paper stack loaded on the intermediate tray, and a pick-up roller which contacts the bottom of the paper stack. The friction acting between the pick-up roller and the paper stack is selected to be greater than the friction acting between the paper sheets themselves, so that the lowermost paper sheet is separated from the others and fed to a separating and transporting member pair. The presser member is movable, when a paper sheet enters the intermediate tray, to an inoperative position for not interfering with the incoming paper sheet and, in the event of refeed, to an operative position for pressing the top of the paper stack, as mentioned above.

Although the pneumatic separation scheme is surely operable, it needs a space for accommodating an exclusive fan and ductwork and produces annoying noise ascribable to suction. Moreover, the exclusive fan aggravates power consumption. The frictional separation scheme which does not need such a fan or ductwork enhances a miniature construction, produces no noise, and prevents the power consumption from being aggravated.

However, when paper sheets of the kind tending to curl are used, the paper sheet separated from the overlying paper sheets by the pick-up roller is apt to curl upward at the leading edge thereof and fail to enter the contacting portion of the separating and transporting member pair smoothly, resulting in a paper jam. The frictional separation scheme, therefore, needs an extra guide member which complicates the construction and increases the cost. Let this drawback be called a first drawback.

Further, the conventional frictional separation scheme needs exclusive drive means for moving the presser member between the inoperative position and the operative position, as stated earlier. A stop is associated with the intermediate tray for positioning paper sheets sequentially stacked on the tray. The stop is movable between an operative position where it abuts against the leading edge of an incoming paper sheet and an inoperative position where it does not interfere with an outgoing paper sheet. The stop has to be acutated by another exclusive drive means. The independent drive means exclusively assigned to the presser member and the stop increase the cost of the intermediate paper feeding device and prevent the device from having a miniature construction. This drawback will be referred to as a second drawback.

It has been customary with the frictional separation scheme to press, in the event of refeed, the presser member against the top of the paper stack so as to press the bottom of the paper stack against the pick-up roller, thereby feeding out the lowermost paper sheet. A prerequisite for the bottom of the paper stack and the pick-up roller to surely press against each other is that the presser member makes surface-to-surface contact with the top of the stack. To meet this requirement, it is a common practice to provide the presser member with a flat pressing surface so that the presser member may evenly press the top of the paper stack and thereby surely urge the stack against the pick-up roller. However, the number of paper sheets to be stacked on the intermediate tray differs each time, and the thickness of the paper stack on the tray sequentially decreases as the refeeding operation proceeds. Since the conventional presser member is simply supported in a rotatable manner, its pressing surface fails to make surface-to-surface contact with the top of the paper stack whose thickness changes, i.e., the former in due course is caused into line-to-line contact with the latter. As a result, the pick-up roller and the paper stack are prevented from pressing against each other by a predetermined pressure, resulting in misfeed. This drawback will be referred to as a third drawback.

SUMMARY OF THE INVENTION

It is therefore an object of the present invention to provide a bottom feed type intermediate paper feeding device which uses the frictional separation scheme and, yet, eliminates the first to third drawbacks discussed above.

It is another object of the present invention to provide a bottom feed type intermediate paper feeding device capable of guiding a paper sheet toward the contacting portion of a separating and transporting member pair smoothly and surely with a simple construction which does not include an exclusive guide member.

It is another object of the present invention to provide a bottom feed type intermediate paper feeding device which uses the frictional separation scheme and, yet, has an inexpensive and miniature construction.

It is another object of the present invention to provide a bottom feed type intermediate paper feeding device which, despite the use of the frictional separation scheme, surely maintains a presser member in surface-to-surface contact with the top of a paper stack with no regard to the thickness of the stack, thereby eliminating misfeed.

It is another object of the present invention to provide a generally improved intermediate paper feeding device for a copier operable in a two-side copy mode.

In accordance with the present invention, an intermediate paper feeding device for a copier operable in a two-side copy mode has an intermediate tray. A stop adjoins the front end of the intermediate tray with respect to an intended direction of paper refeed and is rotatable between an operative position for positioning a paper sheet entered the intermediate tray from the rear end in abutment against the paper sheet and an inoperative position for not interfering with the paper sheet when the latter is refed. A pick-up roller contacts a front end portion of the bottom of a stack of paper sheets which are sequentially stacked on the intermediate tray and positioned by the stop and pressed by a presser member on the top thereof, for feeding the paper sheets, the lowermost one being first. Separating and transporting members are located downstream of the pick-up roller and at opposite sides of a paper transport path. The stop is movable, in the event of refeed, to the inoperative position for guiding the paper sheet fed out by the pick-up roller toward the separating and transporting members.

Also, in accordance with the present invention, an intermediate paper feeding devie for a copier operable in a two-side copy mode has an intermediate tray. A stop has an engaging portion and adjoins the front end of the tray with respect to an intended direction of paper refeed. The stop is rotatable between an operative position for positioning a paper sheet entered the intermediate tray from the rear end in abutment against the paper sheet and an inoperative position for not interfering with the paper sheet when the latter is refed. A driver rotates the stop between the operative position and the inoperative position. A presser member has an engaging portion and is rotatable between an operative position for pressing, in the event of refeed, the top of a stack of paper sheets sequentially stacked on the intermediate tray and positioned by the stop and an inoperative position for not interfering with a paper sheet entering the tray. A pick-up roller contacts, in the event of refeed, a front end portion of the bottom of the stack being pressed by the presser member for feeding the paper sheets, lowermost one being first. The presser rotates, when the stop is in the operative position, to the inoperative position in which the engaging portion of the presser member and the engaging portion of the stop abut against each other, and rotates, when the stop is in the inoperative position, to the operative position in which the engaging portions are released from each other.

Further, in accordance with the present invention, an intermediate paper feeding device for a copier operable in a two-side copy mode has an intermediate tray. A stop has an engaging portion and adjoins the front end of the intermediate tray with respect to an intended direction of paper refeed. The stop is rotatable between an operative position for positioning a paper sheet entered the intermediate tray from the rear end in abutment against the paper sheet and an inoperative position for not interfering with the paper sheet when the latter is refed. A presser member is rotatable between an operative position for pressing, in the event of refeed, the top of a stack of paper sheets sequentially stacked on the intermediate tray and positioned by the stop and an inoperative position for not interfering with a paper sheet entering the tray. The presser member has a flat pressing surface which makes, when the presser member is in the operative position, surface-to-surface contact with the top of the stack on the intermediate tray for pressing the top. The presser member is movable toward and away from the intermediate tray when in the inoperative position. A pick-up roller contacts, in the event of refeed, a front end portion of the bottom of the stack being pressed by the presser member for feeding the paper sheets, lowermost one being first.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
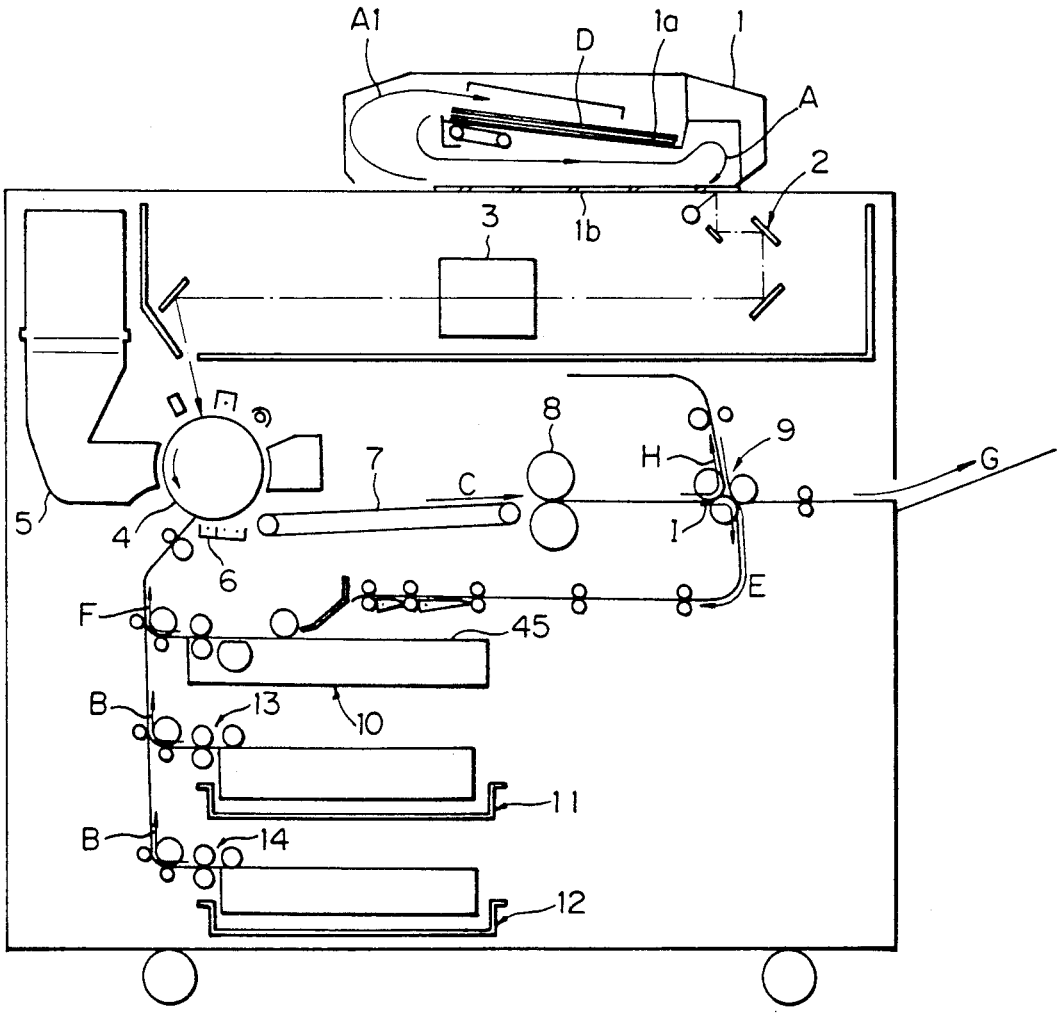
FIG. 1 is a sectional side elevation showing a specific construction of a copier having a recyclic automatic document feeder and to which the present invention is applicable.

Referring to FIG. 1 of the drawings, a copier with a two-side copying capability and having a recyclic automatic document feeder (RADF) is shown to which the present invention is applicable. As shown, an RADF 1 has a document tray 1*a* which is loaded with a stack of documents D. The documents D are fed one by one, the lowermost one being first, to a glass platen 1*b* in a direction indicated by an arrow A in the figure. While the document D reached the glass platen 1*b* is illuminated, an imagewise reflection therefrom is routed through an illuminating unit 2 and a lens 3 to a photoconductive element 4 in the form of a drum which is rotating counterclockwise. As a result, a latent image representative of the document is electrostatically formed on the drum 4. A developing unit 5 develops the latent image to produce a corresponding toner image. A transfer charger 6 located in an image transfer station transfers the toner image to a paper sheet or similar medium which is fed from a paper feeding device 11 or 12 by a feed roller 13 or 14 as indicated by an arrow B. The paper sheet carrying the toner image thereon is transported to a fixing unit 8 by a belt 7 as indicated by an arrow C. The fixing unit 8 fixes the toner image on the paper sheet by heat. In a one-side copy mode, the paper sheet coming out of the fixing unit 8 is driven out of the copier in a direction indicated by an arrow B. On the other hand, in a two-side copy mode, a reversing device 9 implemented with three coactive rollers by way of example reverses the orientation of the paper sheet as to the leading and trailing edges thereof. Specifically, the paper sheet is fed backward toward an intermediate tray 45 included in an intermediate paper feeding device 10. In the intermediate tray 45, the paper sheet is stacked face up with the leading edge thereof abutting against a stop 29, FIG. 2, which is positioned in the vicinity of the front end of the tray 45.

The RADF 1 feeds each document D to the glass platen 1*b* to illuminate one side thereof once and then returns it face down to the top of the paper stack on the tray 1*a*, as indicated by an arrow A1. After all the documents D stacked on the tray 1*a* have their one side reproduced, they are again fed one by one to illuminate the other side thereof. The resulted images are transferred to the other side of the paper sheets which are refed from the intermediate paper feeding device 10 as indicated by an arrow F. Then, the paper sheets or two-sided copies are driven out of the copier in the direction G. In this manner, the opposite sides of the documents D are illuminated in the same order, and the paper sheets stacked on the intermediate tray 45 are sequentially refed, lowermost one being first.

In a composite copy mode, a paper sheet carrying an image on one side thereof is directly transported to the intermediate paper feeding device 10 in a direction I without being reversed by the reversing device 9. Such a paper sheet is stacked on the intermediate tray 45 face down. Again, these one-sided paper sheets are refed from the tray 45 to the drum 4, lowermost one being first, with the result that images are transferred over the existing images.

As stated above, in both of the two-sided copy mode and the composite copy mode, a lowermost one of the paper sheets stacked on the intermediate paper feeding device 10 is refed to the drum 4 first. This type of device 10 is usually referred to as a bottom feed type paper feeding device, as stated earlier. The present invention pertains to this type of intermediate paper feeding device.

Figure 2:
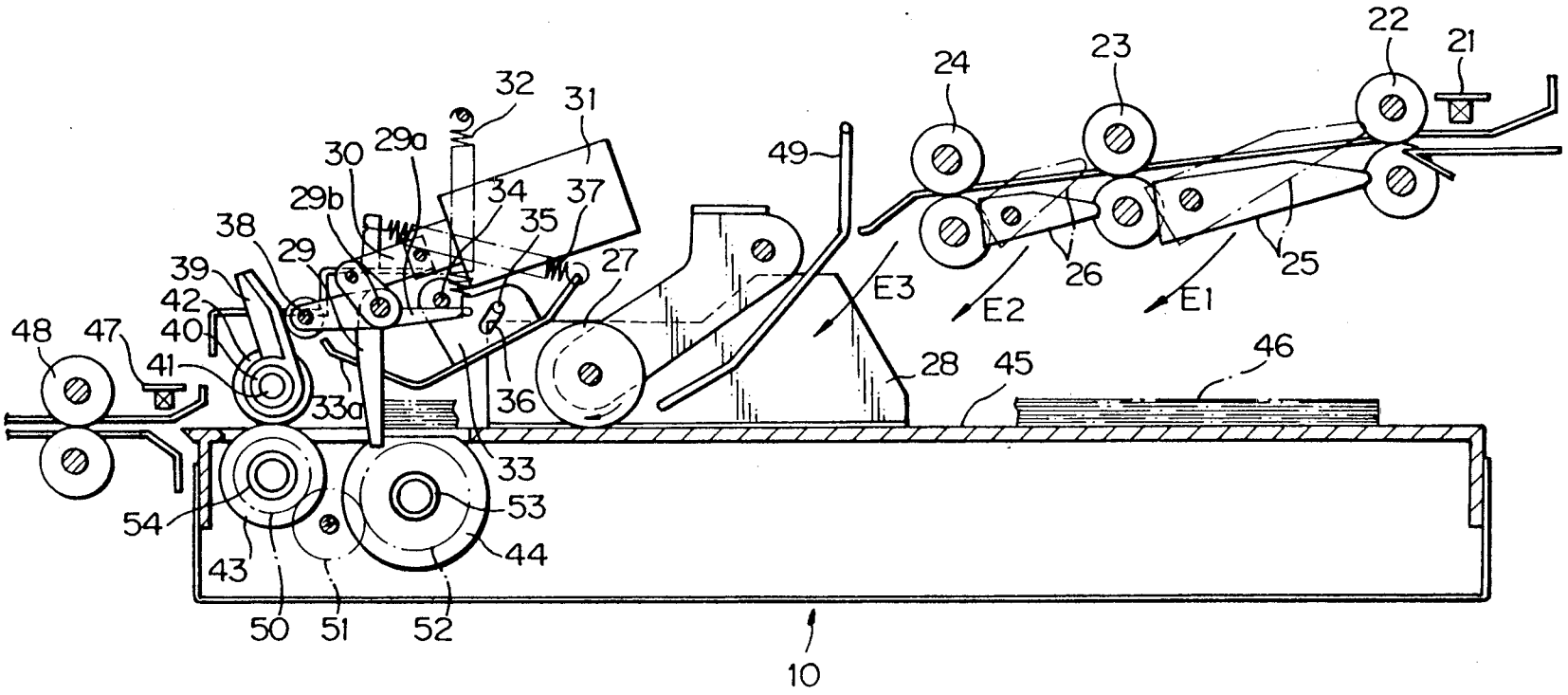
FIG. 2 is a sectional side elevation showing an intermediate paper feeding device embodying the present invention.
Figure 3:
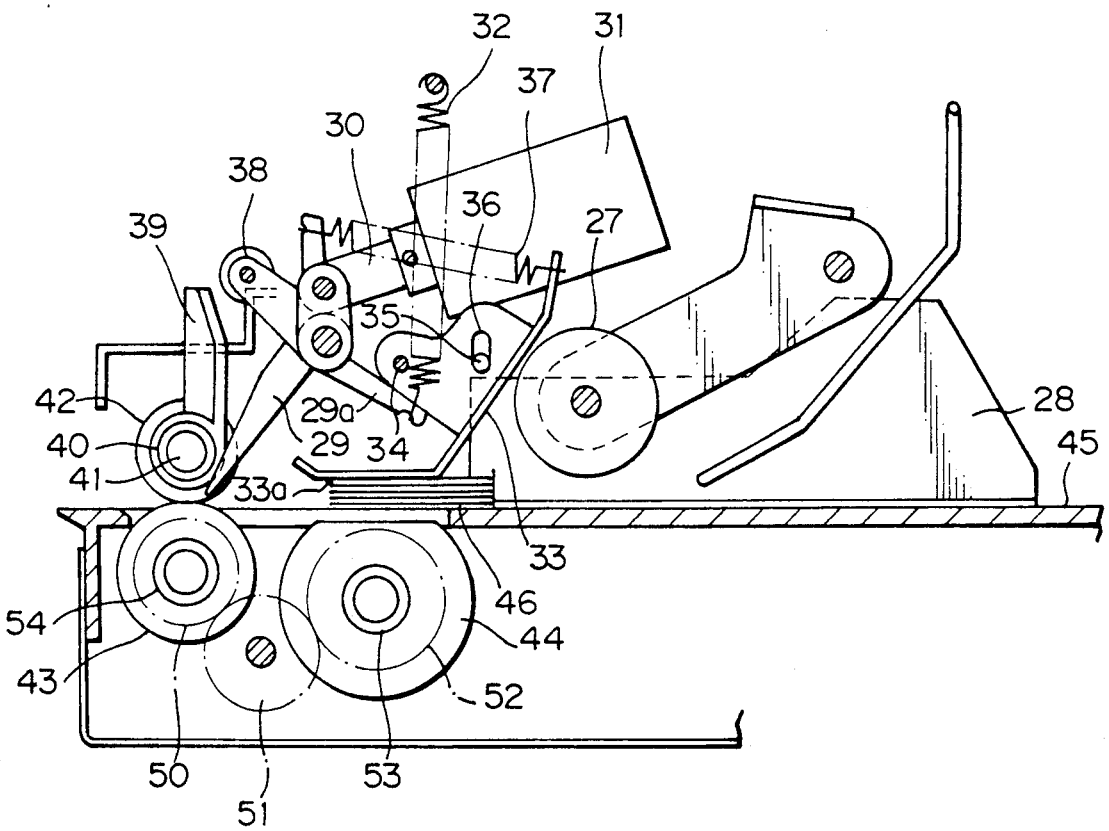
FIG. 3 is a fragmentary sectional side elevation of the illustrative embodiment.

Referring to FIGS. 2 and 3, an intermediate paper feeding device embodying the present invention will be described. FIG. 2 shows the illustrative embodiment in a condition for stacking one-sided paper sheets or copies, while FIG. 3 shows a front end portion of the same in a condition for refeeding such paper sheets. As shown in FIG. 2, an inlet sensor 21 responsive to the leading edge of a paper sheet and three roller pairs 22, 23 and 24 are arranged one after another along a path extending from the reversing device 9, FIG. 1, to the intermediate paper feeding device 10. A first gate 25 and a second gate 26 are interposed between the roller pairs 22 and 23 and between the roller pairs 23 and 24, respectively. The gates 25 and 26 each is opened or closed by a solenoid, not shown, in matching relation to a paper size. For example, when the size of a paper sheet is A3 or B4, the gate 25 is opened to a position indicated by a phantom line with the result that the paper sheet is driven by the roller pair 22 to the intermediate tray 45 along the underside of the gate 25, as indicated by an arrow E1. When the size of a paper sheet is A4 or B5, the gate 25 is held in a closed position indicated by a solid line while the gate 26 is opened to a position indicated by a phantom line. Then, the paper sheet is driven by the roller pairs 22 and 23 to the tray 45 along the underside of the tray 26, as indicated by an arrow E2. Further, when the size of a paper sheet is A5, both of the gates 25 and 26 are held in their closed positions, as indicated by solid lines in the figure. In this condition, the paper sheet is driven by the roller pairs 22, 23 and 24 to the tray 45 along a paper guide 49, as indicated by an arrow E3 (see FIGS. 4*a* and 4*b*).

A positioning roller 27 is located downstream of the lower end of the paper guide 49 and movable into and out of contact with the intermediate tray 45. The stop 29 is located downstream of the positioning roller 27 and angularly movable between an operative position shown in FIG. 2 and an inoperative position shown in FIG. 3 about a shaft 29*b*. In the operative position, the stop 29 causes a paper sheet coming in the tray 45 from the rear end of the latter to abut thereagainst and thereby positions it. In the inoperative or retracted position, the stop 29 does not interfere with the refeed of paper sheets from the tray 45, as will be described. While paper sheets are sequentially stacked on the tray 45, the positioning roller 27 is constantly rotated clockwise as viewed in FIG. 2 and caused into and out of contact with the tray 45 by a solenoid, not shown. Specifically, the positioning roller 27 is brought into contact with an incoming paper sheet on the turn-on of the solenoid or out of contact with it on the turn-off of the solenoid. As a result, a paper sheet driven into the tray 45 by the roller pairs 22, 23 and 24 and gates 25 and 26 is further driven by the positioning roller 27 until the leading edge thereof abuts against the stop 29. The solenoid associated with the positioning roller 27 is turned on and off paper by paper at an adequate timing which is determined by the inlet sensor 21 (see FIGS. 4*d* and 4*e*). Should be positioning roller 27 be constantly held in contact with a paper sheet, the paper sheet would be further driven and thereby deformed after the abutment thereof against the stop 29. A jogger fence 28 is driven by a stepping motor, not shown, to position paper sheets in the right-and-left direction of the latter. The jogger fence 28 is also driven at particular timings on the basis of the output of the inlet sensor 21 (see FIG. 4*f*).

The gates 25 an 26, positioning roller 27 and jogger fence 28 are controllably driven at the specific timings shown in FIGS. 4*a*–4*g* until a given number of paper sheets 46 have been stacked on the intermediate tray 45.

Hereinafter will be described a mechanism for refeeding paper sheets from the intermediate tray 45 and the operation thereof.

A pick-up roller 44 is disposed below the intermediate tray 45 and faces the leading edge portion of the paper stack 46 having been positioned by the stop 29 through a slot formed in the tray 45. Specifically, the pick-up roller 44 is removed in a part of the circumference thereof so as to contact the bottom of the paper stack 46 except for the removed portion thereof. A presser plate 33 is associated with the pick-up roller 44 to press the leading edge portion of the paper stack 46 from above. The presser plate 33 is a specific form of a pressing member. The plate 33 is mounted on a shaft 35 in such a manner as to be rotatable between an operative position shown in FIG. 3 and an inoperative position shown in FIG. 2. In the operative position, the plate 33 presses itself against the top of the paper stack 46 in the event of refeed while, in the inoperative position, it does not interfere with an incoming paper sheet to be stacked on the tray 45. While paper sheets are sequentially stacked on the tray 45, the stop 29 held in the position shown FIG. 2 raises the presser plate 33 with an arm 29*a* thereof abutting against a pin 34 which is studded on the presser plate 33. In this condition, the presser plate 33 assumes the inoperative position spaced apart from the tray 45, as shown in FIG. 2, and therefore does not obstruct a paper sheet entering the tray 45. The stop 29 mounted on the shaft 29*b* is constantaly biased counterclockwise by a return spring 32 and connected to a solenoid 31 by a link 30 which is pivotally connected to the stop 29. In the condition shown in FIG. 2, the solenoid 30 is turned off so that the stop 29 remains in the operative position.

Figures 4A, 4B, 4C, 4D, 4E, 4F, 4G:
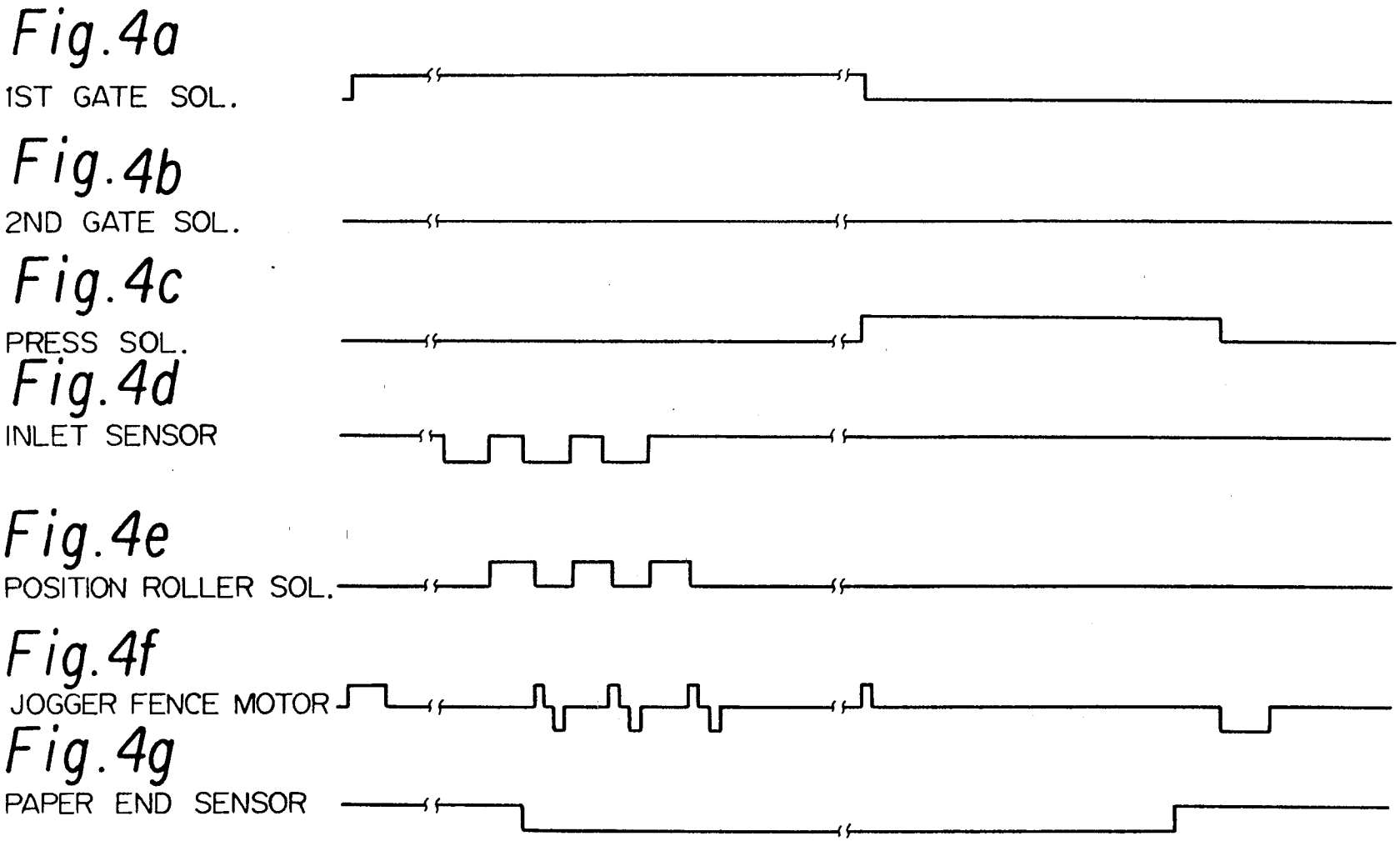
FIGS. 4*a*–4*g* show a timing chart useful for understanding the operations of major members included in the illustrative embodiment.

When the paper sheets 46 are to be refed from the intermediate tray 45, the solenoid 31 is turned on to rotate the stop 29 clockwise to the inoperative position, FIG. 3, via the link 30. As a result, a clearance great enough for a paper sheet to pass is defined between the leading end of the stop 29 and the tray 45. Since the arm 29*a* of the stop 29 is moved clockwise, the presser plate 33 is rotated counterclockwise about the shaft 35 to the operative position by a spring 37 which is anchored at one end to the plate 33 and at the other end to the framework of the copier. Consequently, as shown in FIG. 3, the presser plate 33 presses the top of the paper stack 46 with a pressing surface 33*a* thereof under the action of the spring 37. A specific operation timing of the solenoid 31 is shown in FIG. 4*c*.

As stated above, when the stop 29 is in the operative position shown in FIG. 2, the arm 29*a* thereof abuts against the pin 34 to raise the presser plate 33 to the inoperative position. As the stop 29 is rotated to the inoperative position thereof, the arm 29*a* is released from the pin 34 to bring the presser plate 33 into the operative position.

A feed roller 43 and a reverse roller 42 are located downstream of the stop 29 and face each other at opposite sides of a paper transport path. The feed roller 43 is rotatable counterclockwise to feed a paper sheet to the left as viewed in FIG. 3, while the reverse roller 42 is prevented from rotating when a paper sheet is fed out from the intermediate tray 45. These rollers 42 and 43 constitute a separating roller pair and are operatively connected by a gear train 50, 51 and 52. A clutch, not shown, is coupled by a refeed signal to in turn rotate the feed roller 43 counterclockwise. The pick-up roller 44 is rotated in synchronism with and in the same direction as the feed roller 43 from the home position shown in FIG. 3, i.e., the position where the removed portion of the roller 44 faces the paper stack 45. Then, the presser plate 33 caused into the operative position presses the paper stack 46 against the other or non-removed portion of the pick-up roller 44. As a result, the plate 33 and roller 44 cooperate to drive the lowermost paper sheet out of of the stack 46 to the left as viewed in FIG. 3, due to the friction acting between the lowermost paper sheet and the roller 44. In this manner, in the event of refeed, the pick-up roller 44 is caused into contact with the underside of the paper stack 46 being pressed from above by the presser plate 33, thereby feeding out the lowermost paper sheet.

In the above condition, the stop 29 assumes the inoperative position with the tip thereof facing the contacting portion or nip portion of the feed roller and reverse roller, or separating rollers, 43 and 42, as shown in FIG. 3. Hence, the stop surface of the stop 29 for positioning the paper sheets 46 plays the role of a guide surface which guides the leading edge of a paper sheet being refed to the nip portion of the rollers 43 and 42. The stop 29, therefore, allows a paper sheet to reach the nip portion of the rollers 43 and 42 smoothly. The rollers 43 and 42 in turn prevents two or more paper sheets from being refed at the same time. A pull-out roller pair 48, FIG. 2, further drives the paper sheet coming out of the roller pair 43 and 42 to the image transfer station mentioned previously. More specifically, when two or more paper sheets are fed out together to between the feed roller 43 and the reverse roller 42 which contacts the roller 43 and is not rotated, the paper sheets other than the lowermost one are prevented from being fed out. After the paper sheet has been nipped by the pull-out roller 48, the previously mentioned clutch is uncoupled. At this instant, the pick-up roller 44 is brought to a stop at the home position shown in FIG. 3, but the feed roller 43 is driven via a one-way clutch 54. As a result, the feed roller 43 is rotated by the paper sheet being pulled by the pull-out roller pair 48 and, therefore, does not exert any load on the paper sheet. Although not shown in the figures, a home position sensor and a cam are associated with the pick-up roller 44 in order to cause the roller 44 into a stop at the home position thereof after one full rotation.

The procedure described above is repeated until all the paper sheets have been refed from thd intermediate tray 45. Then, the solenoid 31 is turned off with the result, that the stop 29 is returned to the operative position, FIG. 2, by the return spring 32. Since the arm 29*a* of the stop 29 urges the pin 34 of the presser plate 33 upward, the plate 33 is raised to the inoperative position, FIG. 2, against the action of the spring 37. In this condition, the intermediate paper feeding device 10 is ready to stack other paper sheets on the intermediate tray 45.

As stated above, the stop 29 not only positions papers sheets sequentially stacked on the intermediate tray 45 but also, at the time of refeed, plays the role of a guide for guiding the paper sheets toward the contacting portion of the feed roller 43 and reverse roller 42. This eliminates the need for an exclusive guide member and thereby reduces the cost. Further, the stop 29 is driven by the solenoid 31 to move between the operative and inoperative positions, and the presser plate 33 is actuated in interlocked relation to the stop 29 due to the arm 29*a* and pin 34. Hence, exclusive means for driving the presser plate 33 is not necessary. This cuts down the cost and simplifies the construction of the intermediate paper feeding device 10.

At the time of refeed, the presser plate 33 presses the top of the paper stack 46 and thereby causes the bottom of the paper stack 46 to press against the pick-up roller 44. As a result, a predetermined pressure is developed between the bottom of the paper stack 46 and the pick-up roller 44. A prerequisite for the pick-up roller 44 and the bottom of the paper stack 46 to remain in positive contact is that the presser plate 33 be maintained in surface-to-surface contact with the top of the stack 46. To meet this prerequisite, the presser plate 33 is provided with a flat pressing surface 33*a* which remains in surface-to-surface contact with and presses the top of the paper stack 46 in the operative position of the plate 33 shown in FIG. 3. However, the problem is that the number of paper sheets to be stacked on the tray 45 is not constant and, moreover, the thickness of the paper stack 46 decreases as the paper sheets are refed one by one. In a conventional intermediate paper feeding device wherein a presser plate is simply rotatably supported, the plate is apt to make line-to-line contact with the top of a paper stack. Specifically, assume that the paper stack 46 loaded on the tray 45 and pressed from the above by the pressing surface 33*a* of the presser plate 33 decreases in thickness due to refeed. Then, as the presser plate 33*a* is rotated counterclockwise, its pressing surface 33*a* fails to remain parallel with the top of the paper stack 46 and, instead, the corners and edge of the plate 33 make line-to-line contact with the paper stack 46. Such incomplete contact of the paper stack 46 and pick-up roller 44 often invites misfeed of paper sheets.

The illustrative embodiment is distinguishable over such a conventional arrangement in that the presser plate 33 is movable toward and away from the intermediate tray 45 when held in the operative position shown in FIG. 3. Specifically, the shaft 35 rotatably supporing the plate 33 is received in a slot 36 formed through the plate 33. The slot 36 extends in a direction for pressing the paper stack, i.e., in the up-and-down direction in the figure when the plate 33 is in the operative position. In this configuration, the plate 33 is movable perpendicularly to the top of the paper stack 46. In the condition shown in FIG. 3, the plate 33 is held in the uppermost position due to the thickness of the paper stack 46. As the paper stack 46 becomes thinner during the refeed operation, the plate 33 is sequentially lowered with the pressing surface 33*a* thereof remaining in surface-to-surface contact with the top of the paper stack 46. More specifically, whatever the thickness of the paper stack 46 on the tray 45 may be or despite the change in the thickness of the paper stack 46 ascribable to refeed, the plate 33 remains in surface-to-surface contact over substantially the entire area of the pressing surface 33*a* thereof. The pressing surface 33*a*, therefore, evenly presses the top of the paper stack 46 under the action of the spring 37. This insures a predetermined pressure between the pick-up roller 44 and the bottom of the paper stack 46 and thereby successfully feeds the paper sheets one by one while eliminating misfeed.

The reverse roller 42 held in contact with the feed roller 43 does not rotate when a paper sheet is fed out from the intermediate tray 45, as stated earlier. The illustrative embodiment further includes an implementation for changing the portion of the reverse roller 42 that contacts the feed roller 43 at all times. Specifically, the reverse roller 42 is mounted on a shaft 41 while a lever 39 is operatively connected to the shaft 41 via a one-way clutch 40. The lever 39 is rotatable between the positions shown in FIGS. 2 and 3 and is constantly biased by a spring, not shown, toward the position shown in FIG. 3. Further, in the position shown in FIG. 2, the lever 39 is engaged with a roller which is mounted on the tip of an arm 38 which is in turn affixed to the shaft 29*b* of the stop 29. In this configuration, every time the solenoid 31 is turned on and off, the lever 39 is moved back and forth to rotate the reverse roller 42 by a predetermined amount in one direction. As a result, the reverse roller 42 is allowed to contact the feed roller 43 in a different portion thereof. The reverse roller 42 is therefore free from local wear and achieves an extended service life. Such a rotation of the reverse roller 42 is imparted to the feed roller 43 and gears 50, 51 and 52, but it does not reach the pick-up roller 44 due to the one-way clutch 53 and allows the roller 44 to remain in the home position thereof. In the figures, the reference numberal 47 designates a refeed sensor whose output is used as a reference signal for the control over a paper sheet refed from the device 10.

FIGS. 4*a*–4*g* show specific operation timings of the solenoids and sensors described above and relating to paper sheets of size A4.

FIG. 4*g* represents the operation of a paper end sensor which determines whether or not paper sheets exist on the intermediate tray 45.

In summary, in accordance with the present invention, a stop for positioning paper sheets stacked on an intermediate tray guides, in the event of refeed, a paper sheet toward the contacting portion of a separating member pair. This eliminates the need for an exclusive guide member and thereby reduces the cost, while eliminating paper jams.

A presser member for pressing the top of a paper stack loaded on the intermediate tray is operated in interlocked relation to the stop. The stop and presser member, therefore, can share single drive means. This implements an inexpensive and simple intermediate paper feeding device.

Moreover, the presser member has a pressing surface which remains in surface-to-surface contact with the top of the paper stack on the tray over substantially the entire area thereof with no regard to the thickness of the paper stack. As a result, a predetermined pressure is insured between a pick-up roller adapted to feed the paper sheets, lowermost one being first, and the bottom of the paper stack, allowing the paper sheets to be fed accurately one by one.

Various modifications will become possible for those skilled in the art after receiving the teachings of the present disclosure without departing from the scope thereof. For example, the pick-up roller 44 which is removed in a part of the circumference thereof may be replaced with an ordinary cylindrical roller or a pick-up roller which is movable toward and away from the bottom of the paper stack. The reverse roller 42 cooperating with the feed roller 43 may be rotated in a direction for returning a paper sheet (counterclockwise as viewed in FIG. 3) in the event of refeed. The reverse roller 43 may even be replaced with a blade made of rubber, for example, and pressed against the feed roller 43.

What is claimed is:

1. An intermediate paper feeding device for a copier operable in a two-side copy mode, comprising:

an intermediate tray;

a stop adjoining a front end of said intermediate tray with respect to an intended direction of paper refeed rotatable between an operative position for positioning a paper sheet fed into said intermediate tray from a rear end in abutment against said paper sheet and an inoperative position for not interfering with said paper sheet when said paper sheet is refed;

a pick-up roller contacting a front end portion of the bottom of a stack of paper sheets which are sequentially stacked on said intermediate tray and positioned by said stop and pressed by a presser member on the top of said stack, for feeding said paper sheets, lowermost one being first; and separating and transporting members located downstream of said pick-up roller;

said stop being movable, in the event of refeed, to said inoperative position such that an end portion of said stop extends toward and faces a contacting portion between said separating and transporting members for guiding the paper sheet fed out by said pick-up roller toward said separating and transporting members.

2. An intermediate paper feeding device for a copier operable in a two-side copy mode, comprising:

an intermediate tray;

a stop having an engaging portion and adjoining a front end of said intermediate tray with respect to an intended direction of paper refeed, said stop being rotatable between an operative position for positioning a paper sheet fed into said intermediate tray from a rear end in abutment against said paper sheet and an inoperative position for not interfering with said paper sheet when said paper sheet is refed;

drive means for rotating said stop between said operative position and said inoperative position;

a presser member having an engaging portion and rotatable between an operative position for pressing, in the event of refeed, the top of a stack of paper sheets sequentially stacked on said intermediate tray and positioned by said stop and an inoperative position for not interfering with a paper sheet entering said intermediate tray; and a pick-up roller contacting, in the event of refeed, a front end portion of the bottom of said stack being pressed by said presser member for feeding said paper sheets, lowermost one being first;

said presser member rotating, when said stop is in said operative position, to said inoperative position in which said engaging portion of said presser member and said engaging portion of said stop abut against each other, and rotating, when said stop is in said inoperative position, to said operative position in which said engaging portions are released from each other.

3. An intermediate paper feeding device for a copier operable in a two-sided copy mode, comprising:

an intermediate tray;

a stop having an engaging portion and adjoining a front end of said intermediate tray with respect to an intended direction of paper refeed, said stop being rotatable between an operative position for positioning a paper sheet fed into said intermediate tray from a rear end in abutment against said paper sheet and an inoperative position for not interfering with said paper sheet when said paper sheet is refed;

a presser member mounted on a shaft so as to be rotatable between an operative position for pressing, in the event of refeed, the top of a stack of paper sheets sequentially stacked on said intermediate tray and positioned by said stop and an inoperative position for not interfering with a paper sheet entering said intermediate tray, said presser member having a flat pressing surface which makes, when said presser member is in said operative position, surface-to-surface contact with the top of said stack on said intermediate tray for pressing said top, said presser member comprising means for permitting movement of said presser member toward and away from said intermediate tray after said presser member is in said operative position, said means for permitting movement of said presser member being an elongated slot means formed on said presser member, said shaft of said presser member being movably held on said elongated slot means so as to be movable within a distance defined by said slot means to permit said movement of the presser member; and a pick-up roller contacting, in the event of refeed, a front end portion of the bottom of said stack being pressed by said presser member for feeding said paper sheets, lowermost one being first.

* * * * *